US007741552B2

(12) United States Patent
Walker

(10) Patent No.: US 7,741,552 B2
(45) Date of Patent: Jun. 22, 2010

(54) TRAINING DRUMSTICKS

(76) Inventor: Michael K. Walker, 904 NE. Emily La., Lee's Summit, MO (US) 64086

( * ) Notice: Subject to any disclaimer, the term of this patent is extended or adjusted under 35 U.S.C. 154(b) by 0 days.

(21) Appl. No.: 12/425,928

(22) Filed: Apr. 17, 2009

(65) Prior Publication Data

US 2009/0260503 A1 Oct. 22, 2009

Related U.S. Application Data

(60) Provisional application No. 61/124,446, filed on Apr. 17, 2008.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

| | | | | |
|---|---|---|---|---|
| 1,953,619 | A | 4/1934 | Ludwig | |
| 3,688,013 | A | 8/1972 | Menard | |
| 3,998,123 | A | 12/1976 | Hinger | |
| 4,632,006 | A | 12/1986 | Ambroszewski | |
| 4,640,177 | A | 2/1987 | Elliott, Jr. | |
| 4,651,617 | A | 3/1987 | Schwartz | |
| 5,263,395 | A * | 11/1993 | Phillips | 84/422.4 |
| 5,370,030 | A | 12/1994 | Horne | |
| 5,581,031 | A | 12/1996 | Blankenship et al. | |
| 6,118,062 | A | 9/2000 | Thoman | |
| 6,686,526 | B2 | 2/2004 | Ezbicki | |
| 7,028,581 | B2 | 4/2006 | Williams et al. | |
| 2006/0027073 | A1 * | 2/2006 | Richard | 84/422.4 |

* cited by examiner

*Primary Examiner*—Kimberly R Lockett
(74) *Attorney, Agent, or Firm*—Erickson, Kernell, Derusseau & Kleypas, LLC

(57) ABSTRACT

The present invention provides drumsticks for training percussionists to use proper form, which may increase learning speed and enable faster and more efficient drum strokes. Each drumstick includes a tip or bead with a wing extending therefrom. The wing extends beyond the width of the shaft of the drumstick so that the percussionist must strike the drum head with wing extending parallel to the drum head surface to achieve a proper and acceptable sound. A grip is also provided to properly orient the user's hands for the matched grip variation desired.

11 Claims, 4 Drawing Sheets

TRAINING DRUMSTICKS

CROSS-REFERENCE TO RELATED APPLICATION

This application claims the benefit of provisional patent application Ser. No. 61/124,446, filed Apr. 17, 2008, entitled Training Drumsticks.

FIELD

The present invention relates to drumsticks and, more particularly, to a drumstick for training percussionists to use proper form, which will increase learning speed and enable faster and more efficient drum strokes.

BACKGROUND

Drumsticks for percussionists are generally known in the art. A drumstick is typically made from wood. The drumstick includes a tip or bead which strikes the drum head. Tips may come in many shapes such as acorn, barrel, oval and round. Immediately below the tip is the shoulder of the drumstick which tapers out to the shaft and ends with the butt of the opposite end to the tip. The shaft is typically an elongated, smooth cylinder with no features. Drumsticks vary in length from approximately 15 inches to 17 inches with a shaft diameter of approximately 0.5 inches to 0.6 inches.

The musician may hold the drumsticks in a variety of different manners. One being the overhand matched grip. There are three variations of the overhand matched grip—the French grip, the German grip and the American grip. With the French grip, the musician's palms face each other and control of the drumsticks is mainly accomplished using the fingers. With the German grip the musician holds the drumsticks with the palms parallel to the drum head, providing a more forceful strike. The musician's palms are at a 45 degree angle with an American grip which provides a compromise between the finesse of the French grip and the strength of the German grip.

It is important when learning to play the drums to properly hold the drumsticks and keep the proper hand orientation with respect to the drum head. While playing the drum it is important to keep the proper hand orientation with respect to the drum head depending on the particular grip. A typical drum stick does not provide any indication to the musician what is his or her orientation or if the drumstick is being properly held. Further, as the musician plays, his or her hand orientation may change without any indication or feedback to the musician. Without consistent practice, bad habits form which may prove difficult to correct or overcome.

SUMMARY

The present invention provides drumsticks for training percussionists to use proper form, which may increase learning speed and enable faster and more efficient drum strokes. Each drumstick includes a tip or bead with a wing extending therefrom. The wing extends beyond the width of the shaft of the drumstick so that the percussionist must strike the drum head with wing extending parallel to the drum head surface to achieve a proper and acceptable sound.

The shaft may include a grip or handle to help the percussionist properly hold the drumstick and resist twisting the drumstick in the user's hands. The grips may be formed for a specific hand (i.e., a left hand stick and a right hand stick) or may be ambidextrous in nature.

The wing may be shaped to encourage the user to position the sticks at the proper angle to each other (i.e., at a 90 degree angle to one another). This also allows the user to visually check to see if the sticks are properly aligned and positioned.

DETAILED DESCRIPTION

Figure 1:
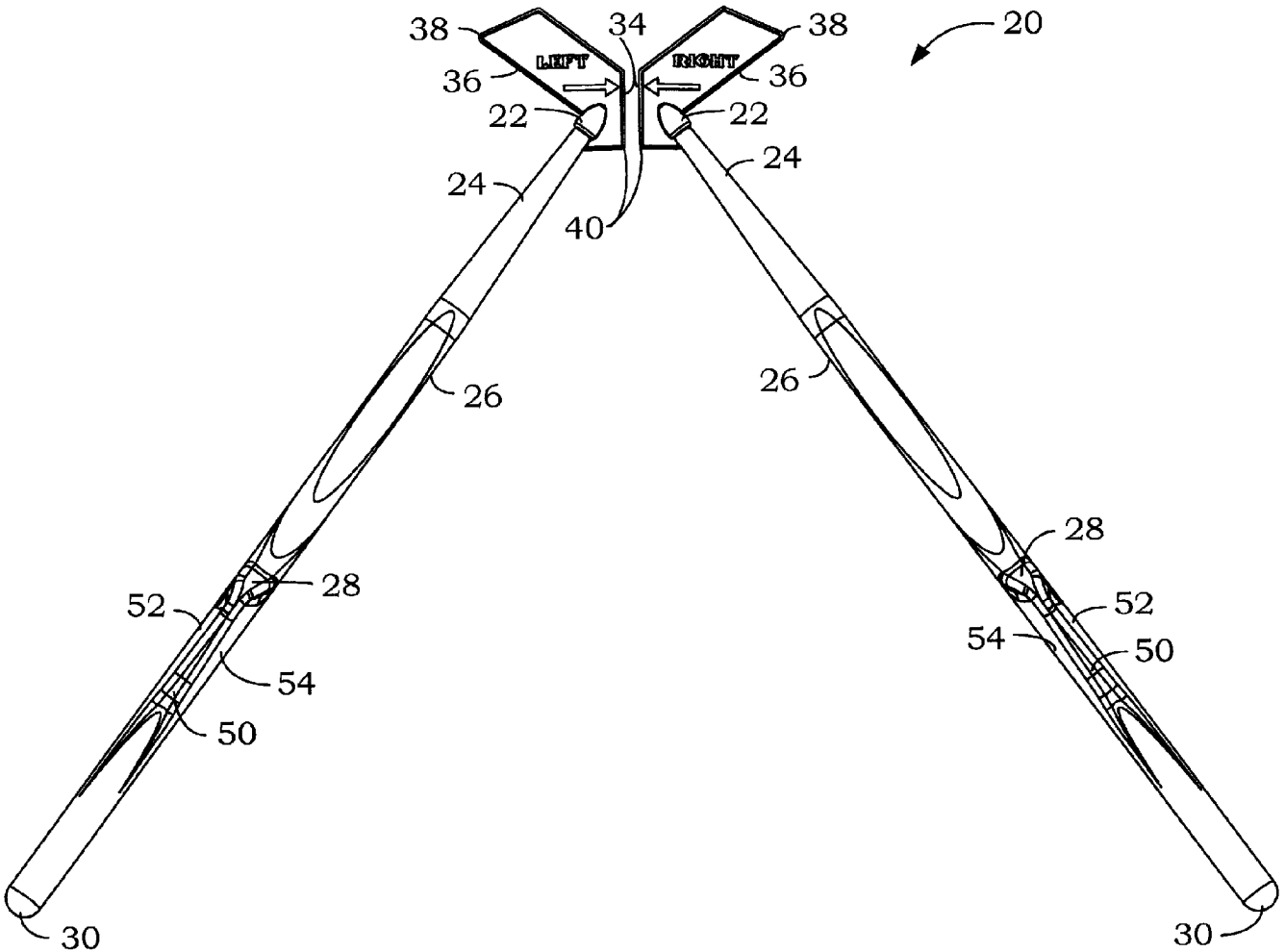
FIG. 1 is a top plan view of a pair of drumsticks of the present invention shown at a 90 degree angle to one another.
Figure 2:
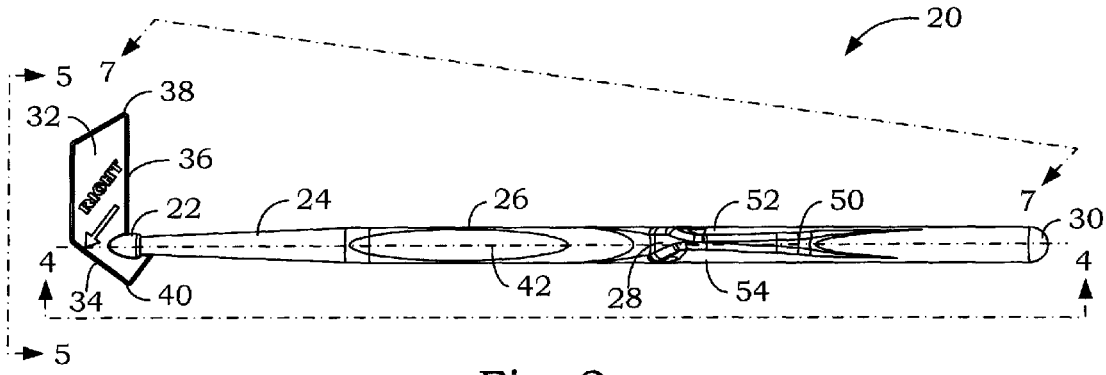
FIG. 2 is an enlarged top view of the right drumstick of FIG. 1.
Figure 3:
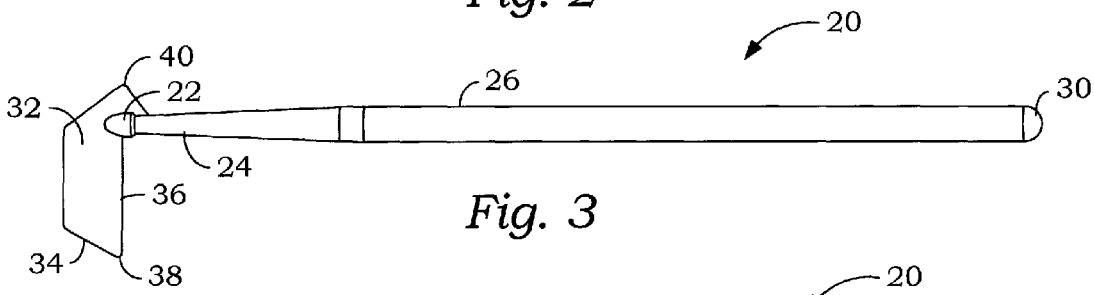
FIG. 3 is a bottom plan view of the drumstick of FIG. 2.
Figure 4:
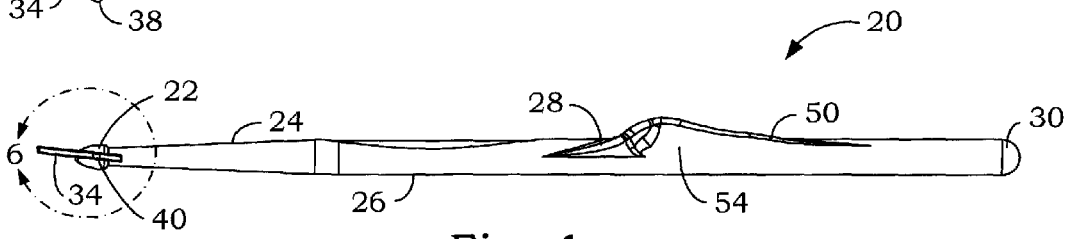
FIG. 4 is a side view of the drumstick of FIG. 2 viewed in the direction of line 4-4.
Figure 6:
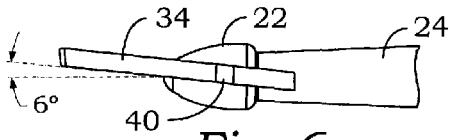
FIG. 6 is an enlarged side view of the top and wing of the drumstick of FIG. 4 at line 6-6.
Figure 5:
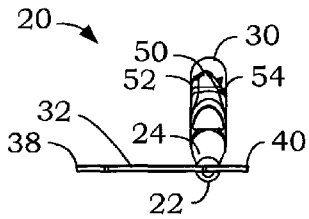
FIG. 5 is an end view of the drumstick of FIG. 2 viewed in the direction of line 5-5.
Figure 7:
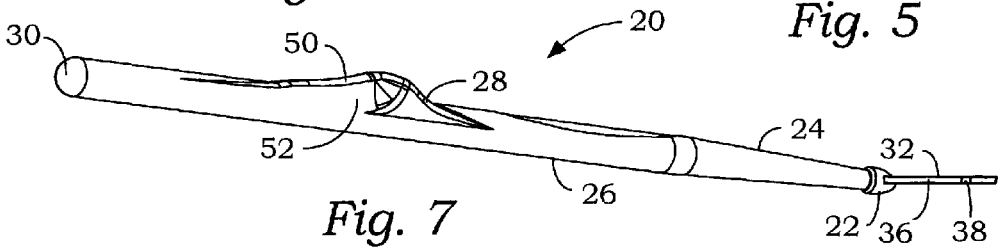
FIG. 7 is a perspective side view of the drumsticks of FIG. 2 viewed in the direction of line 7-7.
Figure 8:
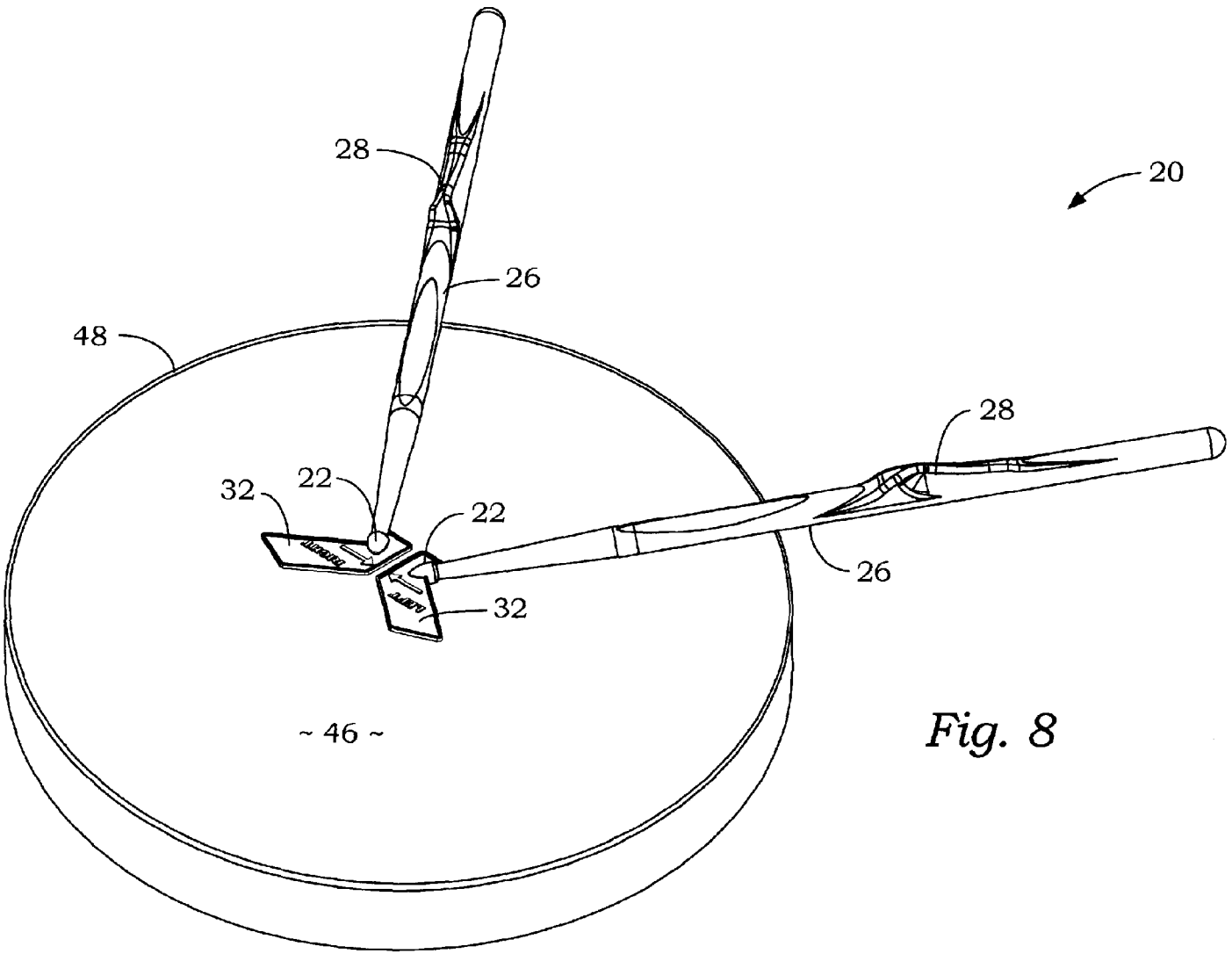
FIG. 8 is a perspective view of the drumsticks shown with respect to a drum head.

Referring initially to FIGS. 1-8, drumsticks (individually or as a pair) are generally indicated by reference numeral 20. As shown in FIGS. 1 and 8, drumsticks 20 are arranged as right and left drumsticks, which are mirror images of each other. Because the features of each drumstick individually in the preferred embodiment are identical, the drumsticks will generally be described below with respect to only one of the drumsticks, namely, the right drumstick.

Drumstick 20 includes a tip or bead 22, a shoulder 24, a shaft 26, a grip or handle 28 and a butt 30. A wing or tab 32 is secured to the tip 22. The wing 32 is generally trapezoidally shaped with an elongated inside edge 34. The wing 32 is secured to the tip 22 near the elongated inside edge 34, and includes a leading edge 35 and a trailing edge 36 which are generally perpendicular to a longitudinal axis 42 of the shaft 26. The elongated inside edge 34 is generally oriented at a 45-degree angle to the longitudinal axis 42 of the shaft 26. The elongated inside edge extends to an inner tip or corner 40. The trailing edge 36 extends from the tip 22 to an outer tip 38.

The wing 32 is mounted at a slight angle to the longitudinal axis 42 so that when the tip 22 of drumstick 20 is resting on or striking the surface 46 of the drum head 48, the plane of the wing 32 may be parallel to the drum head surface 46. This parallel orientation of the wing 32 with respect to the surface 46 also aids in properly adjusting the height of the drum head 48 for the user. If the drum head 48 is too low, the leading edge 35 of the wing 32 may strike the surface 46 and the wing 32 will not be parallel to the surface 46. In the preferred embodiment, the wing 32 is mounted at an angle of six degrees. The wing 32 may be integrally formed with the drumstick 20 as shown in the figure or may be removably or permanently attached to the tip 22.

The handle or grip 28 is formed with the shaft 26 and positioned at approximately the center of mass of the drumstick 20 so that when gripped the drumstick 20 is balanced in the user's hand. The handle 28 includes a ridge 50 separating an index finger indentation 52 and a thumb indentation 54. The handle 28 provides a natural positioning of the user's hand, which is also the proper grip for the drumstick 20. The handle 28 provides an ergonomic conformance to the user's hand. As shown, the handle 28 is positioned to correspond to the American grip. It should be understood that the handle 28 may be positioned to correspond to the French or German grips. In a preferred embodiment, the handle 28 is molded with the shaft 26 resulting in a set of drumsticks 20 configured to correspond to a particular grip. However, a separate grip may be adapted to be attached or releasably positioned on the shaft 26 of the drumstick 20 allowing the user to add a handle 28 to a standard drumstick, for example.

Figure 9:
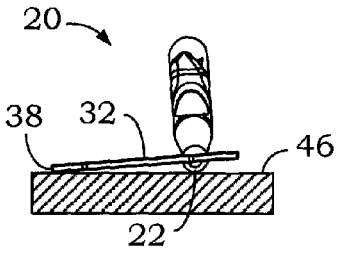
FIG. 9 is a drumstick of FIG. 5 shown rotated to the right with respect to a drum head.
Figure 10:
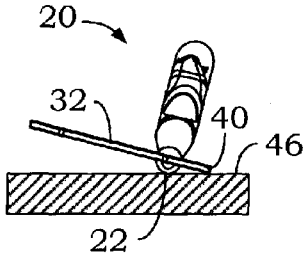
FIG. 10 is the drumstick of FIG. 5 shown rotated to the left with respect to the drum head.
Figure 11:
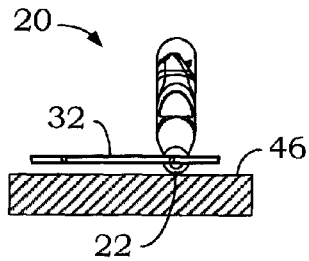
FIG. 11 is the drumstick of FIG. 5 shown properly aligned with respect to the drum head.

Referring to FIGS. 9-11, when striking the surface 46 of drum head 48, it is desirable for the user to position his or her hands properly not only as to the location gripped along the shaft 26, but also with respect to the orientation of the user's hands. If rotated too far outwardly, striking the drum head surface 46 lacks power. When the user's hands are rotated outwardly, the outer tip 38 of the wing 32 may strike the surface 46 at the same time or before the tip 22 of the drumstick 20 (see FIG. 9). Not only is the sound produced not clear or as crisp as it would be if only the tip 22 strikes the surface 46 (FIG. 11), the user may feel a slight twist or torque about the longitudinal axis 42 of the shaft 26 urging the user to rotate his or her hand to the proper orientation.

Likewise, if the user rotates his or her hands inwardly, striking the drum head surface 46 lacks the precision and finesse. When the user's hands are rotated inwardly, the inner tip 40 of wing 32 may strike the drumhead surface 46 at the same time or before the tip 22 (see FIG. 10). Not only is the sound produced not clear or as crisp as it would be if only the tip 22 strikes the surface 46 (FIG. 11), the user may feel a slight twist or torque about the longitudinal axis 42 of the shaft 26 urging the user to rotate his or her hand to the proper orientation.

Figure 12:
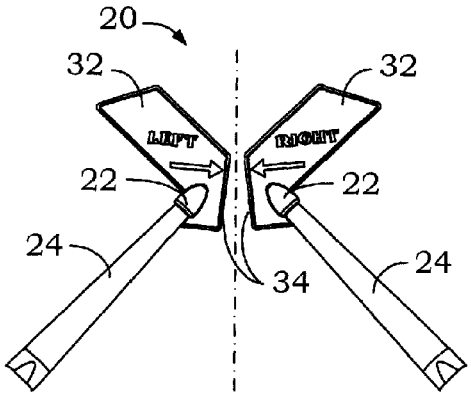
FIG. 12 is a partial view of the drumsticks of FIG. 1 shown rotated outwardly.
Figure 13:
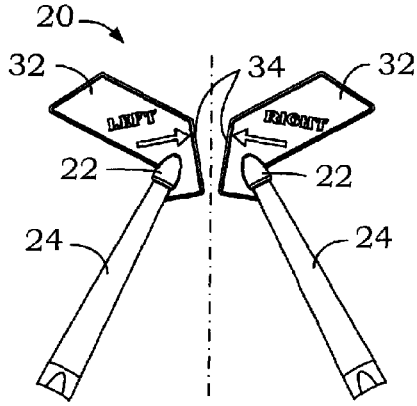
FIG. 13 is a partial view of the drumsticks of FIG. 1 shown rotated inwardly.
Figure 14:
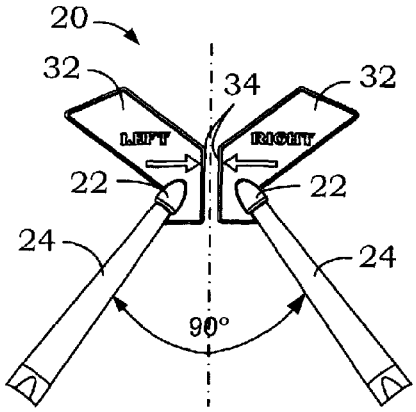
FIG. 14 is a partial view of the drumsticks of FIG. 1 shown properly positioned.

Referring to FIGS. 12-14, the wings 32 of the drumsticks 20 also help the user maintain the proper 90-degree angle to one another (see FIG. 14). If the user has his or her elbows positioned too far from his or her sides, which may result in fatigue and inability to quickly and accurately strike other drums or cymbals (not shown), the elongated inside edges 34 will not be parallel providing a visual indication to the user and/or instructor (see FIG. 12). Likewise, if the user has his or her elbows positioned too close to his or her sides, which may result in interference and not being able to strike the drum surface quickly and accurately, the elongated inside edges 34 will not be parallel, again providing a visual indication to the user and/or instructor (FIG. 13).

It should be understood that the advantages of the wing 32 and grip 28 may be gained individually or in combination. For example, drumsticks 20 with wings 32 attached to the tips 22 may be used to teach the user the proper positioning of his or her hands, wrists and arms with respect to the drum or other surface. The grips 28 attached to the shafts 26 of the drumsticks 20 may be used to teach the user the proper location to hold the drumsticks 20 and the proper hand and finger orientation. The grip 28 may be rotatable or adjustable to accommodate the different matched grips. For a fixed grip 28, the wing 32 attached to the tip 22 may be rotatable to also accommodate the different matched grips. Other configurations of wing 32 may be contemplated which provide auditory, tactile and/or visual indications to the user and/or instructor within the scope of this invention. Other orientations and configurations of the wing 32 may also be used to address specific rotation and orientation issues of a particular student.

Accordingly, it should be understood that while certain forms of the invention have been illustrated and described, it is not limited thereto except insofar as such limitations are included in the following claims.

Having thus described the invention, what is claimed as new and desired to be secured by Letters Patent is:

1. A training drumstick comprising:

a tip, a shaft and a butt opposite said tip;

said shaft having a longitudinal axis;

a wing secured to said tip and extending in a plane on opposite sides of said tip at an angle of approximately six degrees to said longitudinal axis of said shaft;

said wing having an elongated inside edge generally oriented at a 45° angle to said longitudinal axis of said shaft and on a first side of said tip;

said wing having an outer tip opposite said inside edge on a second side of said tip;

wherein when the training drumstick is properly held by a user and said tip is resting on or striking a surface of a drum head, said wing is generally parallel to the surface of the drum head.

2. The training drumstick of claim 1 wherein said wing is generally trapezoidally-shaped having a leading edge having a length and a trailing edge having a length, said leading edge generally perpendicular to said longitudinal axis of said shaft, said trailing edge generally perpendicular to said longitudinal axis of said shaft, wherein said length of said trailing edge is longer than said length of said leading edge.

3. The training drumstick of claim 1 further comprising a grip secured to said shaft.

4. The training drumstick of claim 3 wherein said grip includes a thumb indentation and an index finger indentation.

5. The training drumstick of claim 3 wherein said grip is removably secured to said shaft.

6. The training drumstick of claim 3 wherein said grip is rotatably secured to said shaft.

7. The training drumstick of claim 1 wherein said wing is removably secured to said tip.

8. The training drumstick of claim 1 wherein said wing is rotatably secured to said tip.

9. The training drumstick of claim 1 further comprising a grip having a first indentation adapted to accommodate a user's thumb and a second indentation adapted to accommodate the user's index finger.

10. The training drumstick of claim 1 further comprising a second training drumstick wherein said second training drumstick is a mirror image of said training drumstick presenting left and right drumsticks.

11. The training drumsticks of claim 10 wherein when said left and right drumsticks are properly held by a user said inside edge of said left drumstick is generally parallel to said inside edge of said right drumstick.

* * * * *